United States Patent [19]

Lubbers

[11] Patent Number: 5,034,999

[45] Date of Patent: Jul. 30, 1991

[54] NURSING BIB

[76] Inventor: Karen A. Lubbers, P.O. Box 652, Ulysses, Kans. 67880

[21] Appl. No.: 467,019

[22] Filed: Jan. 18, 1990

[51] Int. Cl.[5] ..... A41D 1/20; A41D 1/22

[52] U.S. Cl. ..... 2/104; 2/49 R; 2/88

[58] Field of Search ..... 2/46, 49 R, 50, 51, 2/52, 88, 104, 248, 249

[56] References Cited

U.S. PATENT DOCUMENTS

| | | | |
|---|---|---|---|
| D. 220,152 | 3/1971 | Bush | 2/50 X |
| 353,954 | 12/1886 | McCarthy | 2/88 |
| 913,694 | 3/1909 | Carpenter | 2/88 |
| 997,304 | 7/1911 | Lederer | 2/88 |
| 1,003,489 | 9/1911 | Moritz | 2/50 |
| 1,098,155 | 5/1914 | Knapp | 2/104 |
| 1,309,537 | 7/1919 | Miller | 2/88 |
| 2,417,888 | 3/1947 | Schuster | 2/104 |
| 2,558,382 | 6/1951 | Prevedi | 2/250 |
| 2,567,524 | 9/1951 | Morganti | 2/49 R |
| 2,593,218 | 4/1952 | Swain | 2/250 |
| 2,738,511 | 3/1956 | Brady | 2/49 R |
| 3,449,763 | 6/1969 | Grate | 2/73 |
| 4,106,122 | 8/1978 | Dodd | 2/104 |
| 4,255,817 | 3/1981 | Heim | 2/49 R X |
| 4,458,365 | 7/1984 | Wood | 2/104 |
| 4,622,699 | 11/1986 | Spriggs | 2/DIG. 7 |
| 4,651,349 | 3/1987 | Heiler | 2/104 |
| 4,660,225 | 4/1987 | Kahn | 2/49 R |
| 4,712,251 | 12/1987 | Cobble | 2/104 |
| 4,771,480 | 9/1988 | Stimpson et al. | 2/88 |
| 4,797,953 | 1/1989 | Dameron | 2/104 |
| 4,873,725 | 10/1989 | Mitchell | 2/48 |

*Primary Examiner*—Werner H. Schroeder
*Assistant Examiner*—Jeanette E. Chapman
*Attorney, Agent, or Firm*—Richard C. Litman

[57] ABSTRACT

A nursing bib completely covers the torso of a mother and her infant. The bib attaches by means of a neck band. The bib has on its front, in the area of the mother's breasts, two portals which can be opened from underneath the bib. The portals can also be opened from outside the drape with the free. These portals allow the mother to see the child while he is nursing without exposing herself or the infant to the outside.

6 Claims, 1 Drawing Sheet

FIG. 1
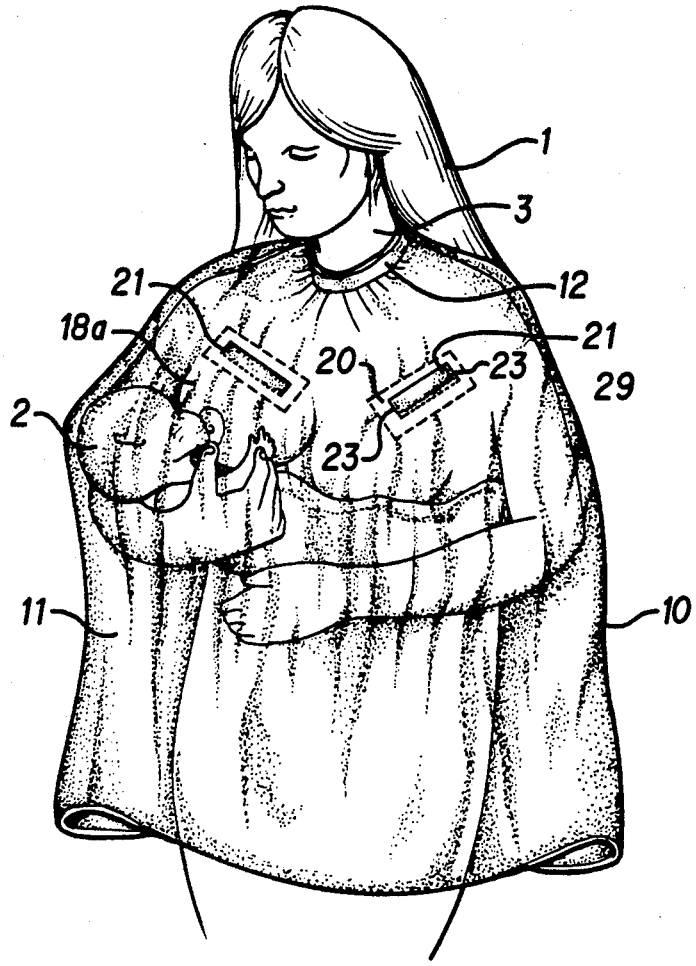
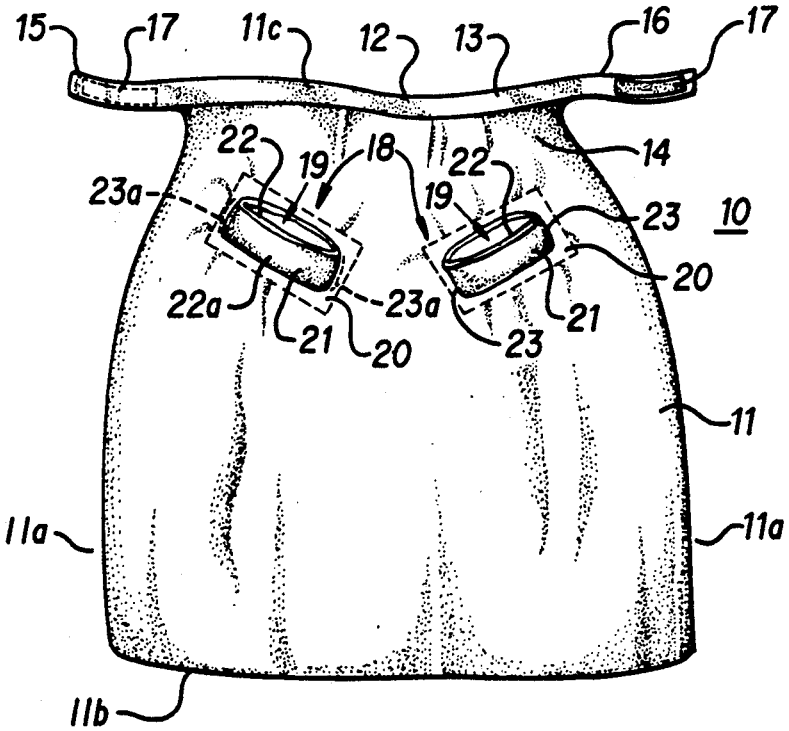
FIG. 2

NURSING BIB

BACKGROUND OF THE INVENTION

1. Field of the Invention

The present invention relates to devices to aid in the nursing of infants. More particularly, it provides a means of sheltering an infant during nursing and maintaining privacy. The bib has means by which the mother can check on the status of the child during nursing.

2. Description of the Prior Art

The following patents are felt to be related to the present invention, but in no way disclose, whether taken singly or in combination, the applicant's present invention.

U.S. Pat. No. 4,458,364 and French Patent No. 1,374,522 issued respectively to Fenninger et al. and Rouyer disclose protective drapes with VELCRO fastening bands. These drapes are for use by barbers to prevent hair from falling onto their customers, and in no way relate to nursing.

U.S. Pat. No. 4,712,251 issued to Cobble discloses a nursing blanket that only partially covers the mother and infant. The device comes in two sections that must be assembled in order to use the device. This would tend to prevent usage of such a device due to a need to assemble it.

U.S. Pat. No. 4,663,782 issued to Knox et al. discloses a blouse having closable openings through which an infant can nurse. This apparatus provides no privacy for the mother when nursing her child.

U.S. Pat. Nos. 4,660,227, 4,601,068, 4,566,136, 4,528,699, 4,280,228 and 2,911,650 issued to Abramson, Frechette, Echols, Hughes, Sulzmann and Gerich respectively disclose garments having overlying layers of fabric that can be pulled aside to expose the mother's breast. These garments also provide no privacy to the mother and infant.

U.S. Pat. No. 4,631,754 issued to Ryan discloses a cover for the mother's torso, but does not have the middle openings presented by the applicant.

What is not disclosed by the prior art is a complete covering for mother and baby that completely shields the mother's breast and the infant from the elements and provides total privacy. This serves to retain the mother's body heat close to the infant and provides comfort to both the mother and infant by not exposing them during periods when the outside is cool.

SUMMARY OF THE INVENTION

The present invention comprises a large drape or bib that is worn by the mother during nursing periods. The bib hangs in front of the mother with the child held behind it at her breast. This completely shields both the mother and her nursing infant from other persons in the vicinity as well as from the elements. The bib is attached around the neck of the mother by means of an easily closable neck band.

Provided on the main front portion of the bib are two sealable openings, one in front of and/or above each breast area, that can be opened by the mother to check visibly on the progress of her infant. These openings can be opened from under the bib, where the mother's hands would be holding the child. These openings are constructed from a flap that is sewn over a reinforced opening. The openings are reinforced so that they do not crease and collapse.

Accordingly, it is one object of the present invention to provide a nursing bib that provides complete privacy for the mother and child.

It is a further object of the present invention to provide a nursing bib that shrouds and protects the upper torso of the mother and infant from the elements.

It is another object of the present invention to provide a nursing bib with frontal openings that allow the mother to check up on the nursing infant.

It is yet another object of the present invention to provide a nursing bib that quickly and easily attaches around the mother.

It is an object of the present invention to provide a nursing bib that is constructed of one piece and is easy to use.

These and other objects of the present invention will become readily apparent upon further review of the following specification and drawings.

BRIEF DESCRIPTION OF THE DRAWINGS

FIG. 1 is a front view of the nursing bib worn by the mother.

FIG. 2 is a front view of the nursing bib with the attachment means opened.

Similar reference characters denote corresponding features consistently throughout the attached drawings.

A DETAILED DESCRIPTION OF THE PREFERRED EMBODIMENT

The present invention 10 is illustrated in use by FIG. 1, with the mother 1 and infant 2 shown in outline. The nursing drape or bib 10 comprises a broad piece or panel of fabric 11 that drapes across the front of the mother's body, including a bottom edge 11*b*, top edge 11*c* and having lateral edges 11*a*, 11*a* defining a width sufficient to insure that, when worn as in FIG. 1, the bib 10 will completely cover at least the front and sides of the upper torso. With this arrangement, the infant 2 will be completely covered while nursing. This protective covering 11 serves to shelter the child and the exposed mother from cool drafts of air while indoors or outside while insuring adequate privacy. The large cover of material 11 serves to retain warm air near the mother's body which will keep the child warm as well as the mother.

The drape 11 is attached around the mother's neck 3 by a band 12 that runs across the top portion of the drape 11. This band 12 has a central portion 13 that is attached to the narrowed top portion 14 of the drape and two free outer ends 15, 16 that extend out beyond the sides 11*a*, 11*a*. Each end 15, 16 of the band 12 has affixed to the its surface an attachment device 17. In this case, as shown in FIG. 2, that device 17 happens to be the respective interlocking surfaces of a hook and loop fastener commonly known as VELCRO. The attachment means 17 could also be conventional interlocking metal or plastic snaps. The band 12 is fastened around the mother's neck as shown in FIG. 1 and the drape 11 hangs in front.

While nursing the infant, the mother will want to check on his or her progress. This is achieved by opening one of the portals 18 above each breast area 18*a*. This allows the mother to check on the infant without having to lift the drape 11. Each portal 18 is constructed by making an opening 19 in the drape 11 over each breast area 18*a* where the child would be nursing, preferably near the infant's head while he is nursing. The openings 19 are slanted downwardly toward the center of the drape 11. This affords the mother a better view of the infant when she opens either one of the portals 18. Each opening 19 is surrounded by a border of reinforcing material such as vinyl sheet or leather 20 to prevent the openings 19 from creasing and folding, thus making them easier to open. Over each opening 19 is a flap 21 of fabric that serves to seal them over when they are not being used to view the infant. Each flap 21 includes side edges 23, 23, a top edge 22 and a bottom edge 22*a*. The edges of this flap 21 are folded over to prevent fraying of the edges. The flap 21 is sewn to the bottom and sides of the opening 19, leaving the top free edge 22 of the flap 21 free to be opened by the mother. Another option for the flap 21 and opening 19 structure is to have the flap 21 made from an elastic material or to have elastic material 23*a* connect two of the opposing sides 23 to the drape 11 as shown in the left-hand portal 18 of FIG. 2. In order to open the portal 18, the mother reaches up from beneath the drape 11 to grasp either the bottom of the drape 11 or the top edge 22 of the flap 21 to pull in the drape or push out the flap 21 in order to expose the opening 19 and the child underneath to the mother's line of sight. The mother can also use her free hand to pull the flap 21 open from the outside of the drape 11. In either instance, the body of the flap 21 will be understood to continue to screen another party's normal view of the mother and infant through the opening 19 and allows visual access solely from an almost vertical angle, such as the mother's eyes. This is assured since the flap 21 is secured along three edges, thereby permitting only its top edge 22 to be slightly displaced outwardly and not folded downwardly.

The whole frontal drape 11 can be made from any lightweight material such as cotton or synthetics such as polyester. Natural woven, porous, materials such as cotton are preferable because of their ability to breathe. A synthetic material such as NYLON wouldn't permit the small amount of airflow through the drape 11 necessary to keep the child from stifling. This would tend to become, in some instances, too hot and stuffy for both the mother and child, as well as unhealthy for the infant if he becomes too hot and sweaty. The band 12 should be made from a natural material such as cotton so as not to irritate the neck.

It is to be understood that the present invention is not limited to the sole embodiment described above, but encompasses any and all embodiments within the scope of the following claims.

I claim:

1. A nursing bib for covering a mother and infant while nursing comprising;

a drape (10) having body attachment means and defining a unitary coextensive panel (11) having an extent shrouding at least the front of the mother's upper torso, said drape panel (11) including substantially horizontal single top (11*c*) and bottom edges (11*b*) bounded by a pair of substantially vertical lateral edges (11*a*, 11*a*), said body attachment means including a neck band (12) affixed to said drape panel top edge (11*c*) and having opposite ends (15, 16) provided with cooperating attachment means (17) thereon, said drape panel (11) including a portal assembly (18) juxtaposed the area of the mother's breast as located therebeneath, said portal assembly (18) including an aperture (19) in said drape panel (11) defining a substantially rectangular configuration, a flap (21) spanning and normally enclosing said aperture (19) and having a plurality of edges (22, 22*a*, 23, 23) including opposite side edges (23, 23), a bottom edge (22*a*) and an uppermost top edge (22), means attaching said flap side and bottom edges (23, 23, 22*a*) to said drape panel (11) to normally maintain said flap (21) in a position closing off said aperture (19) to completely shroud said mother's breasts and nursing infant, said flap top edge (22) disposed substantially normal to and intermediate the mother's line of sight between the mother's eyes and breasts, whereby said mother may view said nursing infant without exposure to the eyes of other persons in front, by displacement of said flap top edge (22) outwardly of said aperture (19) as this displacement allows of downwardly directed visual access to the nursing infant substantially solely along a generally vertical line of sight between said mother's eyes and her breasts.

2. The nursing bib according to claim 1 including:

two of said portals, one disposed adjacent each breast of said mother.

3. The nursing bib according to claim 1, wherein:

said drape is made of a natural, woven, porous fiber material that allows for breathability.

4. The nursing bib according to claim 1 including;

a reinforcing layer of material surrounding said aperture.

5. The nursing bib according to claim 1 wherein;

said attaching means includes elastic means.

6. The nursing bib according to claim 2 wherein;

said apertures are inclined downwardly toward the center of said drape panel.

* * * * *